United States Patent [19]

O'Donnell

[11] 3,994,501

[45] Nov. 30, 1976

[54] GOLF SWING PRACTICE DEVICE

[76] Inventor: W. J. O'Donnell, 412 SE. 43rd Terrace, Cape Coral, Fla. 33904

[22] Filed: July 9, 1975

[21] Appl. No.: 594,343

[52] U.S. Cl. ..... 273/183 A; 273/187 R; 273/195 A; 273/186 R

[51] Int. Cl.[2] ..... A63B 69/36

[58] Field of Search ..... 273/26 B, 186 A, 183 B, 273/195 B, 183 A, 187

[56] References Cited

UNITED STATES PATENTS

| | | | |
|---|---|---|---|
| 3,169,022 | 2/1965 | Kretsinger | 273/183 B |
| 3,413,006 | 11/1968 | Beston | 273/195 B |
| 3,436,076 | 4/1969 | Barthol | 273/26 B |
| 3,861,688 | 1/1975 | Butler | 273/186 A |

FOREIGN PATENTS OR APPLICATIONS

| | | | |
|---|---|---|---|
| 430,762 | 6/1935 | United Kingdom | 273/183 A |

*Primary Examiner*—George J. Marlo
*Attorney, Agent, or Firm*—Alfred E. Wilson

[57] ABSTRACT

This invention consists of an electrically actuated device consisting of a platform on which a golfer stands and a pad having a pressure actuated tee, adapted to support a golf ball; the platform includes a pair of oppositely, normally upwardly angled, pivotal leaf or blade portions for engagement by a golfer's heels.

Electric components are associated with a control box, providing a plurality of switches, the pair of leaf portions and the pressure actuated tee to activate a light, associated with said tee, to indicate to the golfer when he has or has not accomplished a proper weight shift.

Elements are also provided to adjust the tee pad relative to the platform to accommodate each individual golfer. An additional member in the form of a shield, is provided to assist the golfer in developing a correct inside to outside, or through, swing.

9 Claims, 7 Drawing Figures

GOLF SWING PRACTICE DEVICE

BACKGROUND OF THE PRESENT INVENTION

A correct, sound golf swing is generally developed by a golfer only after much practice, over an extended period of time, under the instructions and surveillance of an expert golfer such as a country club professional. Such lessons or instructions are quite expensive and must be taken, generally by appointment, at the convenience of the professional.

The present invention enables a golfer to practice his swing, at home for example, at his own convenience and provides positive means to indicate to the golfer when he is practicing his swing according to the teaching of his professional.

OBJECTS AND ADVANTAGES OF THE PRESENT INVENTION

One of the principal objects of the present invention is to provide immediate visual means to indicate to a golfer when he accomplishes a proper weight shift in his golf swing.

Another principal object of this invention is to provide a platform on which a golfer stands and a pad spaced therefrom, providing a golf tee, including a pressure actuated electric switch means for a tee light which will be illuminated in different modes, with or without a golf ball on the tee, when a golfer using the device accomplishes a proper or sound weight shift.

Yet another object of the instant invention is to provide means, associated with the platform, which sequentially responds to the movements of the right and left heels of a golfer to indicate visually to said golfer by means of the teel light when his or her body movements and resulting weight shift from one heel to the other were properly executed to permit a sound golf swing.

A further object of this invention is to provide said sequentially responding means in the form of a pair of spring loaded, oppositely, upwardly extending pivotal leaf or blade portions for engagement, respectively with the right and left heels of a golfer.

A still further object of the present invention is to provide electric switch means associated with each of said blades and an electric control box to permit operation of the device in a plurality of different modes as determined by proper manipulations of a plurality of switches on said control box.

Another object of the instant invention is to provide adjustment means on the device whereby the tee pad may be adjusted relative to the platform.

A still further object of this invention is to provide a vertical shield, aligned in a spaced relation to the tee, to enable the golfer to develop a proper inside to outside swing whereby the club-head flight pattern will carry the club-head outwardly toward the desired ball flight pattern.

DETAILED DESCRIPTION OF THE DRAWINGS

Figure 1:
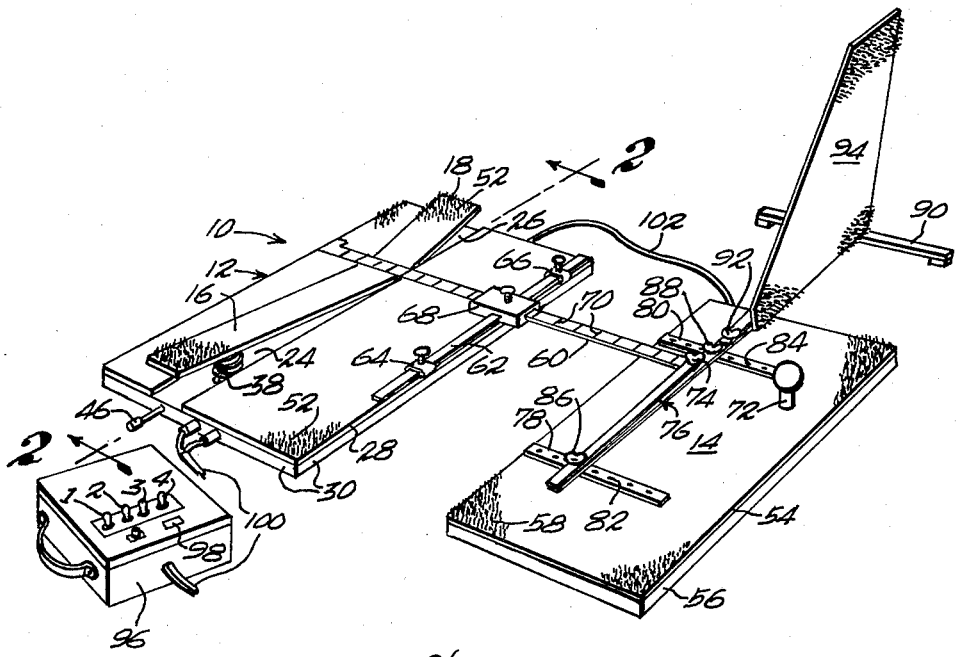
FIG. 1 is a perspective view of the golf swing practice device of the present invention.

With reference to the drawings in which like reference characters designate like or corresponding parts throughout the various views and with particular reference to FIG. 1, the golf swing practice device of the present invention, designated generally at 10, includes a platform 12 and a tee-pad 14.

Figure 2:
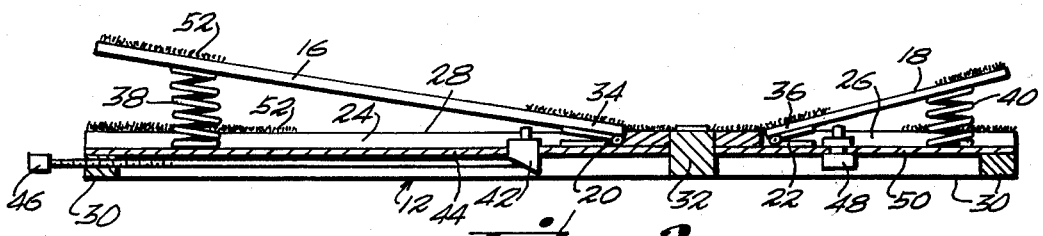
FIG. 2 is a vertical, longitudinal, sectional view taken along the line 2—2 of FIG. 1.

As best illustrated in FIGS. 1 and 2, the platform is provided with a pair of oppositely extending, normally upwardly inclined blades 16 and 18. The blade 18 is substantially shorter than blade 16, both blades 16 and 18 being hinged along their confronting ends at 20 and 22 within longitudinal grooves 24 and 26 formed in the top 28 of platform 12. A peripheral frame 30 supports the top 28 above the ground with a transverse frame member 32, generally bisecting the space between the confronting hinged blade ends 34 and 36. The respective blades 16 and 18 are normally held in the upwardly diverging pattern, illustrated in FIGS. 1 and 2, by respective coil springs 38 and 40. Adjustable electric switch means 42 extends upwardly through the bottom wall 44 of the groove 24. Manual adjustment means 46 extends from the switch 42 outwardly of the platform 12. The adjustment means is illustrated schematically and may be constructed in any conventional manner to permit the switch 42 to be elevated or lowered relative to the inner end of blade 16, electric switch means 46 is fixed through the bottom wall 50 of groove 26 adjacent the inner end of blade 18. As fragmentarily illustrated in FIGS. 1 and 2, synthetic turf 52 may be provided in a covering relationship with all of the exposed top surfaces of the platform 12 including the blades 16 and 18.

With reference to FIG. 1, the tee pad 14 is comprised generally of a top 54 supported above the ground by a peripheral frame 56, the upper surface of the top 54 preferably being covered with a synthetic turf 58.

A bar 60 extends across and forwardly of the platform 12 at a 90° relationship thereto along a line generally bisecting the space between the confronting hinged blade ends 34 and 36. A second bar 62 at right angles to bar 60 is fixed at 64 and 66 relative to the top, front edge of platform 12, and, at the point of intersection, bars 60 and 62 are adjustably clamped together by a screw actuated clamp means 68. The bar 60 preferably has calibrations 70, in inches for example, along its upper surface whereby it is possible to readjust the device by means of clamp means 68 to accommodate a particular golfer, adjusting the spacing between the blades 16 and 18 and a tee 72 carried atop the tee pad 14.

As illustrated in FIG. 1, the forward end of bar 60 is pivotally attached at 74 to a bar means 76 extending longitudinally of the tee pad 14. A pair of spaced apart cross bars 78 and 80 carried by the tee padd 14 are each provided with a plurality of holes as at 82 and 84 to receive the set screws 86 and 88, extending through the bar means 76, for adjustment purposes.

A T-shaped frame member 90 is pivotally attached at 92 to one end of the longitudinal bar means 76 and provides an enlarged, vertical shield 94 to guide the flight of the golf club head and to assist the golfer in maintaining the proper club-head flight pattern to carry the club-head outwardly toward the desired ball flight pattern, the club-head of course swinging in alignment with the shield 94 and forwardly thereof.

An electric control box 96, providing four toggle switches, numbered 1, 2, 3, and 4, and a pilot light 98 is electrically connected to the platform 12 by electric cable means 100. In turn the platform 12 is connected to the tee-pad 14 by an electric cable means 102.

Figure 3:
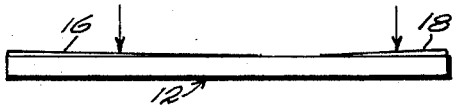
FIGS. 3, 4, 5 and 6 are schematic illustrations of the operation of the device.
Figure 4:
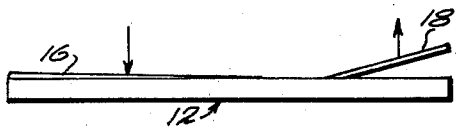
Figure 5:
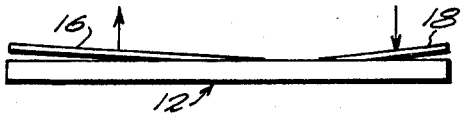
Figure 6:
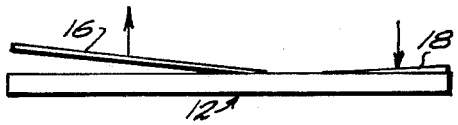

In use, the device can be used in four different modes, to be subsequently described relative to the electric circuit diagram of FIG. 7. Generally, a golfer places himself on the platform facing the tee 72, with his right heel depressing the blade 16 and his left heel depressing the blade 18. In this position, depicted in FIG. 3, the golfer "addresses the ball". FIG. 4 shows the upward movement of the blade 18 during the "back swing", the left heel is raised, the weight being shifted to the right heel. FIG. 5 illustrates the movements of both blades 16 and 18 as the power swing progresses, the left heel moving downwardly and the right heel moving upwardly as the weight shift progresses, FIG. 6 indicates the progressive weight shift to blade 18 by the left heel with the right heel blade 16 being elevated at the point of club-head impact with the golf ball.

Figure 7:
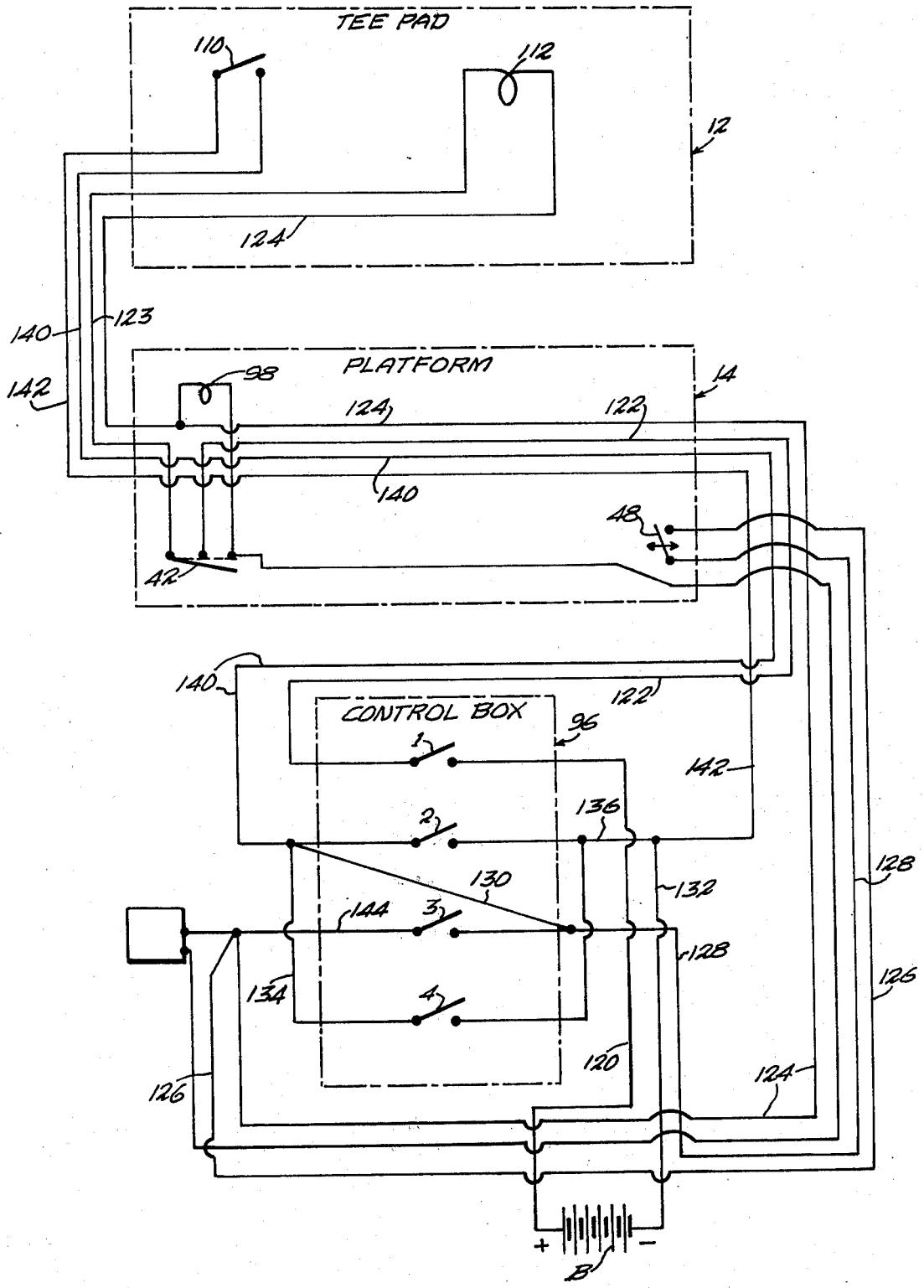
FIG. 7 is a wiring diagram of the electric circuits incorporated in the golf swing practice device of the present invention.

As illustrated in the electrical diagram of FIG. 7, a switch and a tee-light 110 and 112 are associated with the golf tee 72. The switch is pressure activated by the weight of a golf ball to activate the tee-light in two of the four modes of use of the device.

The four modes of operation are determined by the actuation of the four toggle switches 1, 2, 3 and 4 and the four modes are as follows:

Mode 1, toggle switches 1, 2 and 3 are moved to on positions. When the weight is returned to the left heel the electric switch means 48 is actuated to activate the tee-light 112. No golf ball is on the tee.

Mode 2, toggle switches 1 and 4 are moved to on positions. This mode is for swing practice without ball or with a light practice ball. The return of weight to left heel and release of weight from the right heel operates the switches 42 and 48 to activate the light 112.

Mode 3 is for practice with a regular golf ball or special weight practice ball and toggle switches 1 and 3 are turned on. The return of weight to the left heel operates the tee-light, but if the ball is struck from the tee before the weight is shifted to the left, the tee-switch will open and the tee-light 112 will not turn on.

Mode 4 is for practice with a regular golf ball or special weight practice ball and toggle switch 1 is turned on. Release of weight from the right heel and the return of weight to the left heel operates the switches 42 and 48 to activate the tee-light. If the ball is struck from the tee before the weight is shifted off of the right heel and onto the left heel the tee light will not turn on.

With reference to the electrical diagram of FIG. 7 in Mode 1, toggle switches 1, 2 and 3 are moved to closed positions. With a golfer in position on the blades 16 and 18 the current flows from the positive side of a power source such as the battery B through conductors 120 and 122 to the closed right heel switch 42, to the tee-light 112, by means of conductor 123 and back through conductor 124 and conductor 126 to the left heel switch 48. When the weight is properly shifted back to the left foot blade 18, the right heel switch 42 is opened and the left heel switch 48 is closed permitting the current to flow through a conductor 128 back through closed switch number 3 to maintain a circuit through conductor 126, left heel switch 48, through a conductor 130, closed switch number 2 to a return conductor 132 to the negative battery terminal. In this manner, the tee-light 112 is activated to indicate that some weight has been shifted from left to right and back onto the left foot.

In Mode 2, toggle switches 1 and 4 are closed. The current flow as above described, relative to the shifting of the weight, with switch number 1 closed is the same, however, with switch number 4 closed, the current flows from conductor 128 through conductor 130, a conductor 134, closed switch number 4, a conductor 136 to conductor 132 and back to the negative battery terminal. The tee-light is thereby activated to indicate when the weight is shifted to the left heel.

Modes 1 and 2 are primarily for initial practice of the proper weight shift. The tee-light will indicate the proper weight shift but does not correlate it with club to ball impact.

In Mode 3, toggle switches 1 and 3 are closed. The current flow again is the same relative to closed switch number 1. However, a ball of sufficient weight to close the switch 110 is placed on the tee 72. This closes a circuit from conductor 128, conductor 130, a conductor 140, tee-switch 110, a conductor 142 and back to the lead 132 to the negative terminal of the Battery B. Switch number 3 connects by conductor 144 to conductor 126 from the left heel switch 48. With a sound, proper golf swing, the switch 48 will be closed just prior to club contact with the ball, causing the tee light 112 to flash on just prior to ball contact.

In Mode 4, toggle switch 1 is turnedj on and a ball of sufficient weight to close the tee-switch 110 is placed on the tee as in Mode 3. The tee-light indicates the proper weight has been shifted from left to right and then most of the weight shifted back to the left before impact of the club head with the ball, the right heel pressure being released.

Most of the weight should be on the left side at impact; therefore, the adjustable switch 42 as above described has been provided for the right heel. A golfer's progress in weight transfer may be evaluated by the amount of upward adjustment he can set for raising the right heel and still be able to energize the tee light before the club head makes contact. This feature provides an excellent means for practice of the "delayed hit" which is so important to a sound swing. Anticipation of seeing the tee-light flash tends to keep the golfer's head steady, with his eyes glued to the ball, thus allowing the head and neck to provide the axis for the swing.

Ability to select from the four modes of operation permits concentration of teaching and practice on isolated areas of the weight shift.

What is claimed is:

1. A golf swing practice device comprising:

a. a platform member providing 1. blade means, engable by the right heel and the left heel of a golfer positioned to swing a golf club;

b. an enlarged pad including a tee to receive a ball, said tee providing 1. a pressure actuated electric switch calibrated to be activated by the weight of a golf ball, and
2. electric light means;

c. electric power means including a source of electric power and electric circuitry including manually operable switch means associated with the heel actuated blade means and the golf ball pressure actuated switch whereby as the back swing progresses the weight of the golfer is shifted off of the left heel onto the right foot and then as the ball impacting swing progresses the left heel goes down and as the swing progresses the right heel is elevated to release the right foot actuated switch to activate the tee light just prior to the golf club arriving at a ball impacting position over the tee to indicate that a desirable golf swing is being made.

d. control means for said electric circuitry, including a plurality of electric control switches, whereby the tee light may be activated in a plurality of different modes, with or without a ball on the tee.

2. The device as defined in claim 1 including adjustable connection means between said platform and tee pad to adjust the spacing and angularity of said tee pad forwardly of said platform.

3. The device as defined in claim 2 wherein said connection means comprises a first bar, adjustably carried by said platform and including a plurality of calibrations along its length extending forwardly from said platform to a point of pivotal connection to a second bar, adjustably, connected longitudinally of said pad.

4. The device as defined in claim 1 wherein said blade means comprises aa pair of aligned oppositely extending, normally upwardly inclined, diverging blades, hinged to said platform along their confronting ends in respective grooves formed in the upper surface of said platform, each of said blades being positioned for engagement by one of the heels of a golfer in a conventional golf stance.

5. The device as defined in claim 4 wherein each of said blades is normally urged to said upwardly inclined position by a compression spring.

6. The device as claimed in claim 5 wherein said electric switch means comprises electric switches positioned in said grooves beneath the respective blades for sequential engagement thereby when the weight shift on the heels sequentially depresses said blades against said springs.

7. The device as defined in claim 6 wherein the electric switch, positioned beneath the blade engaged by the right heel of a golfer is adjustable upwardly and downwardly and includes means extending outwardly of said platform to accomplish said adjustment.

8. The device as defined in claim 1 wherein said plurality of electric control switches comprises four switches located on a control box, remotely located relative to said platform and pad and comprising said control means.

9. The device as defined in claim 8 including electric conductor conduit means connecting between said control box, platform and pad.

* * * * *